US008276619B2

(12) United States Patent
Morton et al.

(10) Patent No.: US 8,276,619 B2
(45) Date of Patent: Oct. 2, 2012

(54) DRAIN FOR EXHAUST GAS DUCT

(75) Inventors: Ian James Morton, Simpsonville, SC (US); Matthew Johnson, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 525 days.

(21) Appl. No.: 12/572,546

(22) Filed: Oct. 2, 2009

(65) Prior Publication Data

US 2011/0079308 A1 Apr. 7, 2011

(51) Int. Cl.
*F15D 1/04* (2006.01)

(52) U.S. Cl. ..... 138/38; 138/177; 138/DIG. 4

(58) Field of Classification Search ..... 138/39, 138/DIG. 4, 177, 178
See application file for complete search history.

(56) References Cited

U.S. PATENT DOCUMENTS

| | | | | |
|---|---|---|---|---|
| 2,141,797 | A * | 12/1938 | Minella | 138/37 |
| 3,403,702 | A * | 10/1968 | Poole | 138/37 |
| 4,162,546 | A * | 7/1979 | Shortell | 4/696 |
| 4,738,695 | A | 4/1988 | Carr et al. | 95/187 |
| 4,768,444 | A | 9/1988 | DeWerth et al. | 110/160 |
| 5,531,484 | A * | 7/1996 | Kawano | 285/179.2 |
| 7,174,919 | B2 * | 2/2007 | Kenyon et al. | 138/37 |
| 2002/0129863 | A1 * | 9/2002 | Schaake et al. | 138/177 |

* cited by examiner

*Primary Examiner* — Patrick F Brinson
(74) *Attorney, Agent, or Firm* — Nixon & Vanderhye, P.C.

(57) ABSTRACT

An exhaust gas duct includes a hollow duct section having a peripheral wall, a slot in said peripheral wall, the slot opening in a direction counter to a flow direction through the hollow duct section; and a baffle plate located on an exterior surface of the peripheral wall, upstream of the slot relative to the flow direction.

20 Claims, 3 Drawing Sheets

DRAIN FOR EXHAUST GAS DUCT

This invention relates to exhaust-gas ductwork and more specifically, to a drain configuration in the exhaust-gas duct of a gas turbine.

BACKGROUND OF THE INVENTION

On a standard vent-fan, exhaust-gas duct section, there is a drain that allows water, sand and/or other particulates to exit the duct. This drain, however, also allows some exhaust gas flowing through the duct to escape which, depending on the exhaust gas composition, may result in a hazardous gas cloud below the drain. As a result, external devices in the immediate area of the drain are required to be rated for use in a hazardous area, and any electrical devices in those areas any are also required to be explosion proof.

There remains a need, therefore, for an exhaust-gas duct with a drain configuration that allows water sand and/or other particulates to exit the duct, but that also minimizes if not eliminates any potential for a hazardous gas bubble or cloud in an area adjacent the drain.

BRIEF DESCRIPTION OF THE INVENTION

In a first exemplary but nonlimiting aspect, there is provided an exhaust gas duct comprising a hollow duct section having a peripheral wall, a slot in the peripheral wall, the slot opening in a direction counter to a flow direction through the hollow duct section; and a baffle plate located on an exterior surface of the peripheral wall, upstream of the slot relative to the flow direction.

In another aspect, there is provided an exhaust gas duct comprising a hollow duct section having a top wall, bottom wall and a pair of side walls, a lateral slot in the bottom wall, the lateral slot opening in a direction counter to a flow direction through the hollow duct section; and a baffle plate located on an exterior surface of the bottom wall upstream of the lateral slot relative to the lateral flow direction.

In still another aspect, there is provided an exhaust gas duct for removing exhaust gases from a gas turbine comprising a hollow duct section having a top wall, bottom wall and a pair of side walls; a lateral slot in the bottom wall extending substantially between the side walls, the lateral slot opening in a direction counter to a flow direction of exhaust gas through the hollow duct section; and a baffle plate located on an exterior surface of the bottom wall, upstream of the lateral slot relative to the flow direction, the baffle plate formed with a plurality of laterally-spaced apertures, and wherein the lateral slot is defined by vertically-spaced, axially overlapping portions of the bottom wall.

DETAILED DESCRIPTION OF THE INVENTION

Figure 1:
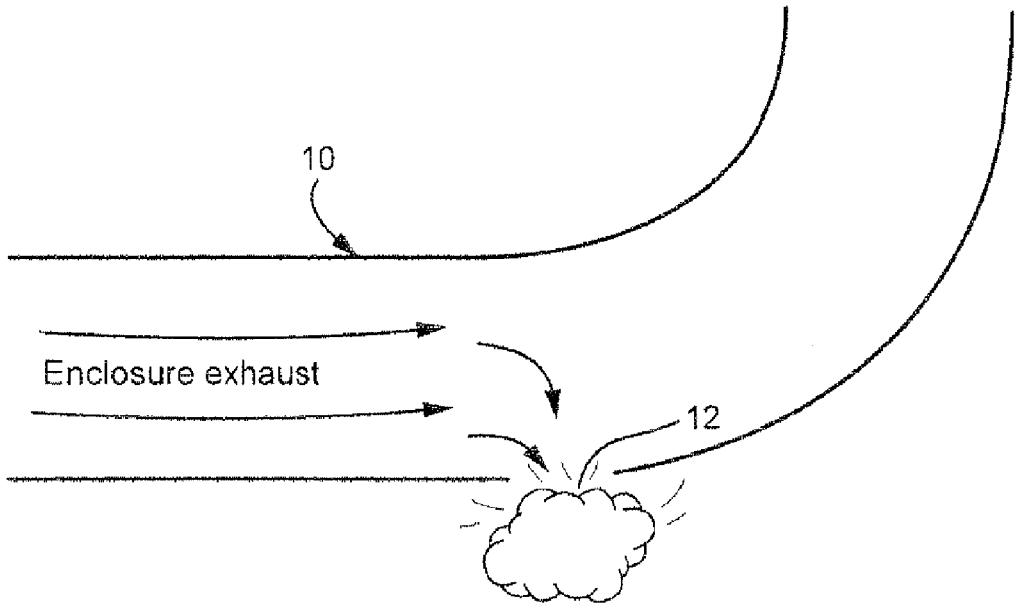
FIG. 1 (PRIOR ART)
FIG. 1 is a schematic representation of a conventional exhaust-gas duct section with a drain that allows water, sand or other debris to exit the duct.

With reference now to FIG. 1, a typical vent-fan, exhaust-gas duct section 10 (connected directly or indirectly to a turbine enclosure or casing, not shown) is formed with a drain hole or aperture 12 that allows water, sand and/or other debris to exit the duct. Because of the drain location and configuration, however, the exhaust gas itself is able to escape the duct through the hole or aperture 12. The situation can be made worse by ambient conditions outside the duct which may in fact, draw the exhaust gas out of the duct. The potential for a hazardous gas cloud or bubble in the area below the drain aperture 12 is of great concern in any environment, and especially where electrical devices are located in proximity to the drain.

Figure 2:
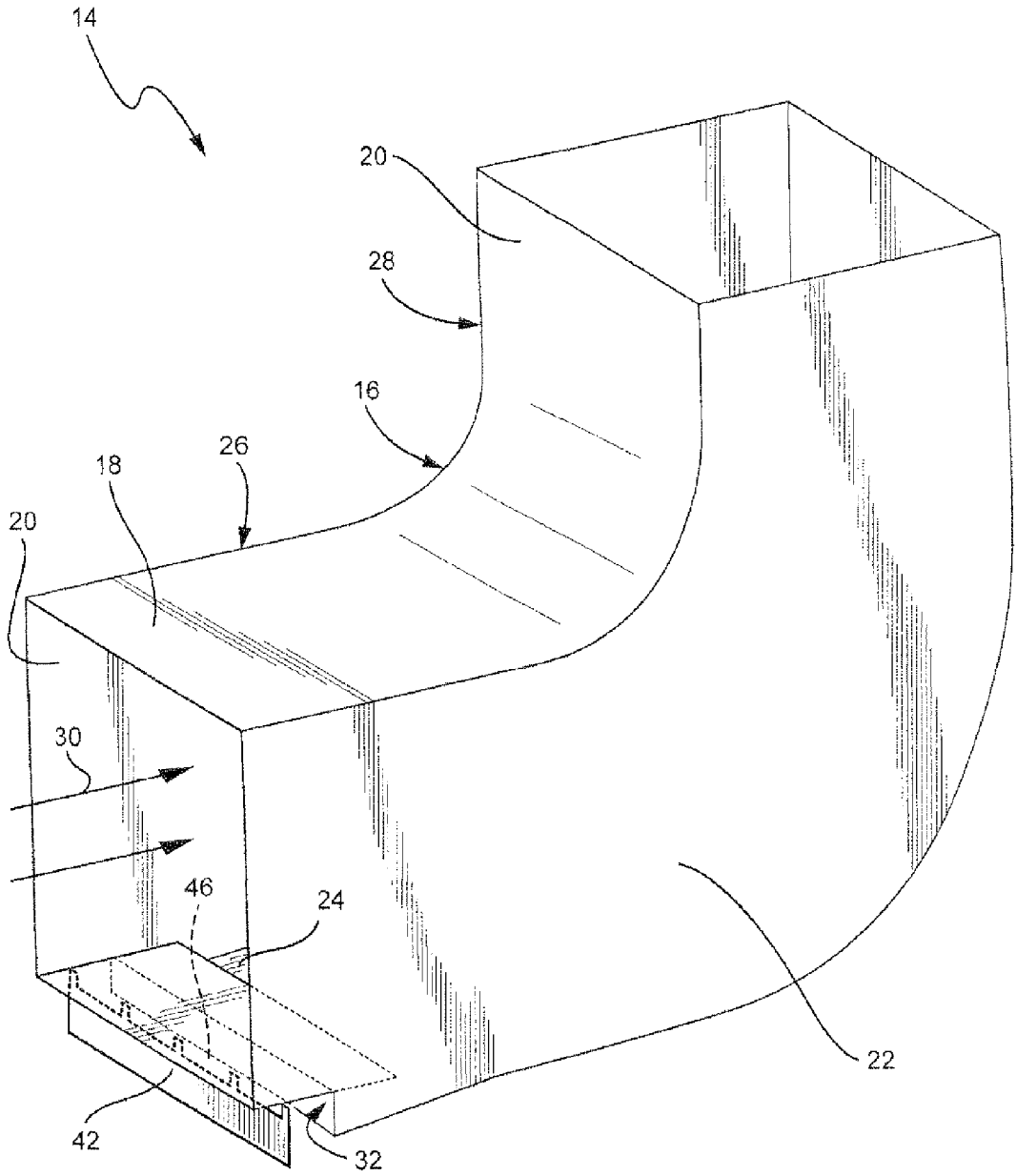
FIG. 2 is a perspective view of an exhaust-gas duct in accordance with a first exemplary but non-limiting embodiment of the invention.

Referring now to FIG. 2, an exhaust-gas duct 14 includes a hollow duct section 16 having a top wall 18, a pair of side walls 20, 22 and a bottom wall 24. The duct section 16 as shown is in the form of a duct elbow but the invention is not limited to a duct section of this particular shape or angle. For example, depending on the particular application, the duct section may be configured to change the direction of flow in a range of from anywhere between about 45 and about 90 degrees. In the illustrated embodiment, the duct section 16 includes a horizontal portion 26 and a vertical portion 28 and, in this orientation, exhaust gas flows from a gas turbine enclosure inlet (not shown) left-to-right as indicated by the flow arrows 30. Thus, the exhaust gas flows horizontally through the horizontal portion 26, turning approximately 90 degrees within the duct elbow and then exiting in a vertical direction beyond the vertical portion 28. In accordance with the exemplary but non-limiting embodiment of this invention, the lower surface or bottom wall 24 of the horizontal portion 26 is formed with a width-wise or lateral slot 32 defined by a first lower edge 34 and a second upper edge 36.

Figure 3:
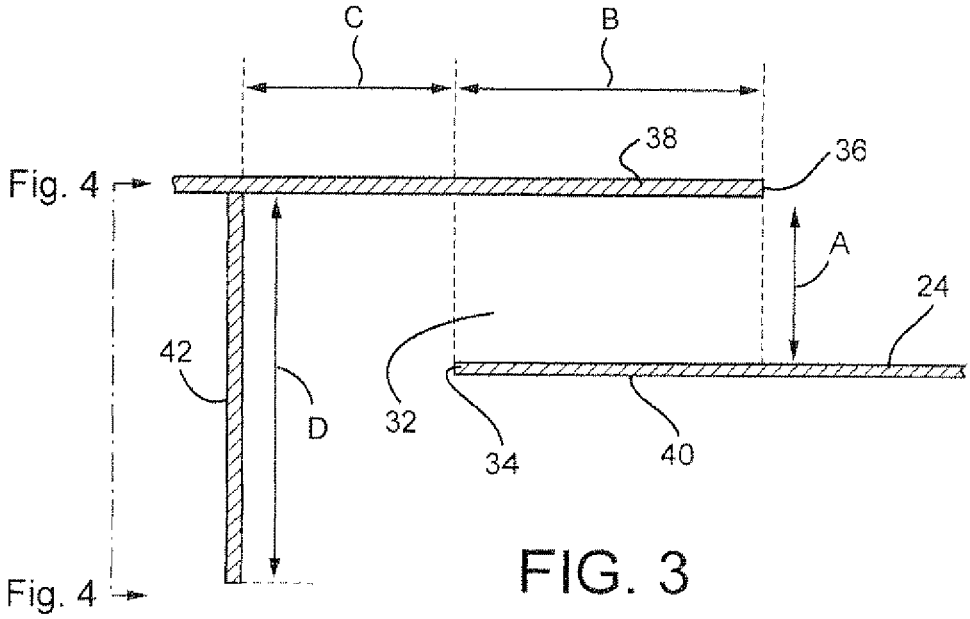
FIG. 3 is an enlarged partial cross-section taken from FIG. 2.

As seen in FIG. 3, and for an exemplary duct having a height of thirty inches and a width of forty inches, the height or depth of the slot may be about one inch (dimension A). The duct bottom wall portion 38, formed with the upper edge 36, axially overlaps the lower edge 34 by approximately, three inches (dimension B). If desired, the duct bottom wall portion 40 formed with the lower edge 34 of the slot may be slightly sloped toward the opening as shown in FIG. 2 to facilitate exit of sand, water and/or other debris from inside the duct section 16. It will be appreciated, however, that the bottom wall portion 40 may remain parallel to the top wall 18 (as in FIG. 3). The lateral slot 32 opens or faces in a direction opposite the direction of the flow of exhaust gas within the duct section.

Figure 4:
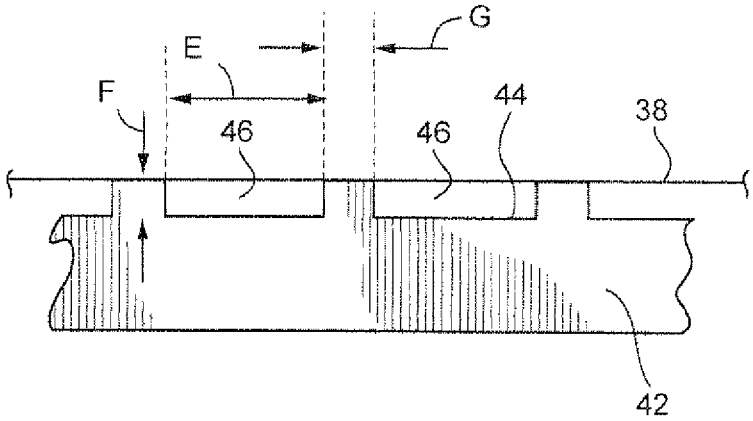
FIG. 4 is a partial enlarged end elevation of a baffle plate taken from FIG. 2.

Forward (upstream relative to the flow direction) of the lateral slot 32 is a vertical baffle plate 42 extending substantially vertically downwardly from an exterior surface of the bottom wall portion 38. In the exemplary but nonlimiting embodiment, the baffle plate 42 is located upstream of the lower edge 34 of the slot 32 by a distance of about three inches (dimension C). The baffle plate 42, as best seen in FIG. 4, is formed with a plurality of laterally-spaced, elongated notches 44 that combine with the bottom wall portion 38 to form laterally-spaced, rectangular apertures 46.

The baffle plate 42 may have a height of about four inches (dimension D), and apertures 46 may have a width of about nine inches (dimension E). The apertures 46 preferably have a height equal to the height of the slot 32 (dimension D), in this example about one inch (dimension F). The apertures 46 may be spaced from each other by about 0.5 inch (dimension G) in this example embodiment. The baffle plate 92 itself should have a width at least equal to the width of the duct section 16.

It will be appreciated, of course, that the various dimensions may vary with specific duct sizes/applications. Thus, the dimensional relationships may be stated differently to cover a wider range of duct sizes. For example, the distance (dimension C) between the duct opening or slot 32 and a baffle plate may be between 200% and 500% of the height (dimension A) of the slot or opening 32.

The height of baffle plate 42 (dimension D) may be between 75%-300% of the height (dimension A) of the opening or slot 32.

The open area of the baffle plate 42, i.e. the cumulative open areas of the apertures 46, may be in a range of 50%-98% of the baffle plate area, and the height of the apertures 46 (dimension F) may be between 40-175% of the height (dimension A) of the duct opening or slot.

In all cases, the horizontal or lateral slot 32 serves to entrain outside or ambient air into the exhaust gas flowing through the duct section 16, and thus prevent exhaust air from escaping the duct. At the same time, the baffle plate 42 prevents high velocity ambient wind from reversing this effect, i.e., from drawing hazardous gas from the duct section 16 through the lateral slot 32 and out into the ambient surroundings. More specifically, the apertures 46 act as a wind-breaker which simultaneously facilitates drawing air into the duct section 16 while preventing exhaust gases from being drawn out of the duct. The above arrangement has proven effective in maintaining control of potentially hazardous gas, until it exits the duct beyond the vertical portion 20.

It will be appreciated, of course, that that the theory and application described herein is also applicable to non-rectangular ducts (for example, round ducts defined by a peripheral wall or other hollow duct shapes) discharging a media where the removal of particulate matter in a direction opposite the normal flow direction, or entrainment of external media, is desired.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An exhaust gas duct comprising a hollow duct section having a peripheral wall, a drain slot in a lower surface of said peripheral wall, said drain slot opening in a second direction facing counter to a flow direction through said hollow duct section; and a baffle plate located on an exterior surface of said peripheral wall, upstream of said drain slot relative to said first flow direction, said hollow duct section and said drain slot arranged to permit water or particulates to drain from the duct in said second direction.

2. The exhaust gas duct of claim 1 wherein said baffle plate is formed with a plurality of apertures.

3. The exhaust gas duct of claim 1 wherein said drain slot is defined by vertically-spaced, axially overlapping portions of said peripheral wall.

4. The exhaust gas duct of claim 1 wherein said baffle plate has a height in a range of about 75%-300% of a height of said drain slot.

5. The exhaust gas duct of claim 4 wherein said apertures each have a height in a range about 40%-175% of said height of said drain slot.

6. The exhaust gas duct of claim 1 wherein said baffle plate is axially-spaced from said drain slot by between 200%-500% of a height dimension of said slot.

7. The exhaust gas duct of claim 1 wherein said hollow duct section is substantially elbow-shaped, configured to change the flow direction by an angle of between about 45 and 90 degrees.

8. The exhaust gas duct of claim 1 wherein said hollow duct section has a round cross-sectional shape.

9. An exhaust gas duct comprising a hollow duct section having a top wall, bottom wall and a pair of side walls, a lateral drain slot in said bottom wall, said lateral drain slot opening facing in a direction counter to a flow direction through said hollow duct section; and a baffle plate located on an exterior surface of said bottom wall upstream of said lateral drain slot relative to said lateral flow direction.

10. The exhaust gas duct of claim 9 wherein said baffle plate is formed with a plurality of laterally-spaced apertures.

11. The exhaust gas duct of claim 9 wherein said lateral drain slot is defined by vertically-spaced, axially overlapping portions of said bottom wall.

12. The exhaust gas duct of claim 10 wherein said hollow duct section has a height of about thirty inches and a width of about forty inches, and each of said laterally-spaced apertures has a width of about nine inches.

13. The exhaust gas duct of claim 12 wherein said lateral drain slot has a height of about one inch.

14. The exhaust gas duct of claim 11 wherein said vertically-spaced axially overlapping portions of said bottom wall have an axial overlap of about three inches.

15. An exhaust gas duct for removing exhaust gases from a gas turbine comprising a hollow duct section having a top wall, bottom wall and a pair of side walls; a lateral drain slot in said bottom wall extending substantially between said side walls, said lateral drain slot opening in a direction facing counter to a flow direction of exhaust gas through said hollow duct section; and a baffle plate located on an exterior surface of said bottom wall, upstream of said lateral drain slot relative to said flow direction, said baffle plate formed with a plurality of laterally-spaced apertures, and wherein said lateral slot is defined by vertically-spaced, axially overlapping portions of said bottom wall, said hollow duct section and said drain slot arranged to permit water or particulates to drain from the duct in said second direction.

16. The exhaust gas duct of claim 15 wherein said baffle plate has a height in a range of about 75%-300% of a height of said lateral slot.

17. The exhaust gas duct of claim 16 wherein said plurality of laterally-spaced apertures each have a height of between 40%-125% of said height of said lateral drain slot.

18. The exhaust gas duct of claim 15 wherein said baffle plate is axially-spaced from said lateral drain slot by between 200%-500% of a height dimension of said lateral slot.

19. The exhaust gas duct of claim 15 wherein said hollow duct section is substantially elbow-shaped, configured to change the flow direction by an angle of between about 45 and 90 degrees.

20. The exhaust gas duct of claim 15 wherein said lateral drain slot has a height substantially equal to a height of each of said plurality of laterally-spaced apertures.

* * * * *